US009980031B2

(12) United States Patent
Witt

(10) Patent No.: US 9,980,031 B2
(45) Date of Patent: May 22, 2018

(54) MODULAR EAR PHONE ASSEMBLY

(71) Applicant: Samuel Witt, Marana, AZ (US)

(72) Inventor: Samuel Witt, Marana, AZ (US)

( * ) Notice: Subject to any disclaimer, the term of this patent is extended or adjusted under 35 U.S.C. 154(b) by 6 days.

(21) Appl. No.: 15/217,434

(22) Filed: Jul. 22, 2016

(65) Prior Publication Data

US 2018/0027318 A1 Jan. 25, 2018

(51) Int. Cl.
*H04R 1/10* (2006.01)
*H04R 1/02* (2006.01)

(52) U.S. Cl.
CPC ..... *H04R 1/1016* (2013.01); *H04R 1/023* (2013.01); *H04R 1/105* (2013.01); *H04R 1/1033* (2013.01); *H04R 1/1041* (2013.01)

(58) Field of Classification Search
CPC .... H04R 1/1008; H04R 5/033; H04R 1/1066; H04R 1/1016; H04R 1/1058; H04R 5/0335; H04R 1/1075; H04R 1/105
See application file for complete search history.

(56) References Cited

U.S. PATENT DOCUMENTS 2,430,229 A * 11/1947 Kelsey ..... H04R 1/1058 181/130
6,466,681 B1 10/2002 Siska, Jr. et al.
7,245,736 B2 7/2007 Tsunoda et al.
8,180,090 B2 5/2012 Hupkes
8,270,648 B2 * 9/2012 Murozaki ..... H04R 1/1091 381/312
8,369,557 B2 2/2013 Kuhtz et al.
8,515,115 B2 8/2013 Kelly et al.
8,542,859 B2 9/2013 Alden
8,722,775 B2 5/2014 Kim et al.
2002/0181729 A1 * 12/2002 Smith ..... H04R 1/105 381/381
2005/0163337 A1 * 7/2005 Ruegg ..... H04R 1/1066 381/370
2007/0036376 A1 2/2007 Fried
2008/0166003 A1 * 7/2008 Hankey ..... H01H 9/0228 381/370
2009/0214071 A1 * 8/2009 Axelsson ..... H04R 1/1016 381/380
2009/0238399 A1 * 9/2009 Miller ..... H04R 1/1033 381/381
2010/0177924 A1 * 7/2010 Xu ..... H04R 1/1033 381/384
2011/0255729 A1 * 10/2011 Tan ..... H04R 1/105 381/380

(Continued)

FOREIGN PATENT DOCUMENTS

WO WO2012024656 2/2012

*Primary Examiner* — Oyesola C Ojo

(57) ABSTRACT

A modular ear phone assembly includes a pair of ear buds. Each of the ear buds may be positioned in ears thereby facilitating each of the ear buds to emit audible sound into the ears. A pair of cords is provided. Each of the cords is selectively electrically coupled to an associated one of the ear buds. A coupler is provided and each of the cords is selectively electrically coupled thereto. A conductor is provided and the conductor is selectively electrically coupled to the coupler. The conductor may be selectively electrically coupled to an audio source. Thus, the ear buds may emit audible sound received from the audio source.

13 Claims, 5 Drawing Sheets

(56) References Cited

U.S. PATENT DOCUMENTS

| | | | | |
|---|---|---|---|---|
| 2013/0336515 | A1* | 12/2013 | Centrilla, III ..... | H04R 1/1033<br>381/384 |
| 2014/0105443 | A1 | 4/2014 | Kennerly et al. | |
| 2015/0055917 | A1 | 2/2015 | Liu et al. | |
| 2016/0127818 | A1* | 5/2016 | Ambrose ..... | H04R 1/1016<br>381/380 |
| 2017/0070803 | A1* | 3/2017 | Pulgam ..... | H04R 1/1016 |

* cited by examiner

MODULAR EAR PHONE ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIE THE OFFICE ELECTRONIC FILING SYSTEM.

Not Applicable f) STATEMENT REGARDING PRIOR DISCLOSURES BY THE INVENTOR OR JOINT INVENTOR

Not Applicable

(g) BACKGROUND OF THE INVENTION (1) Field of the Invention (2) Description of Related Art including information disclosed under 37 CFR 1.97 and 1.98.

The disclosure and prior art relates to ear phone devices and more particularly pertains to a new ear phone device to facilitate individual components of the ear phone device to be replaced.

(h) BRIEF SUMMARY OF THE INVENTION

An embodiment of the disclosure meets the needs presented above by generally comprising a pair of ear buds. Each of the ear buds may be positioned in ears thereby facilitating each of the ear buds to emit audible sound into the ears. A pair of cords is provided. Each of the cords is selectively electrically coupled to an associated one of the ear buds. A coupler is provided and each of the cords is selectively electrically coupled thereto. A conductor is provided and the conductor is selectively electrically coupled to the coupler. The conductor may be selectively electrically coupled to an audio source. Thus, the ear buds may emit audible sound received from the audio source.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
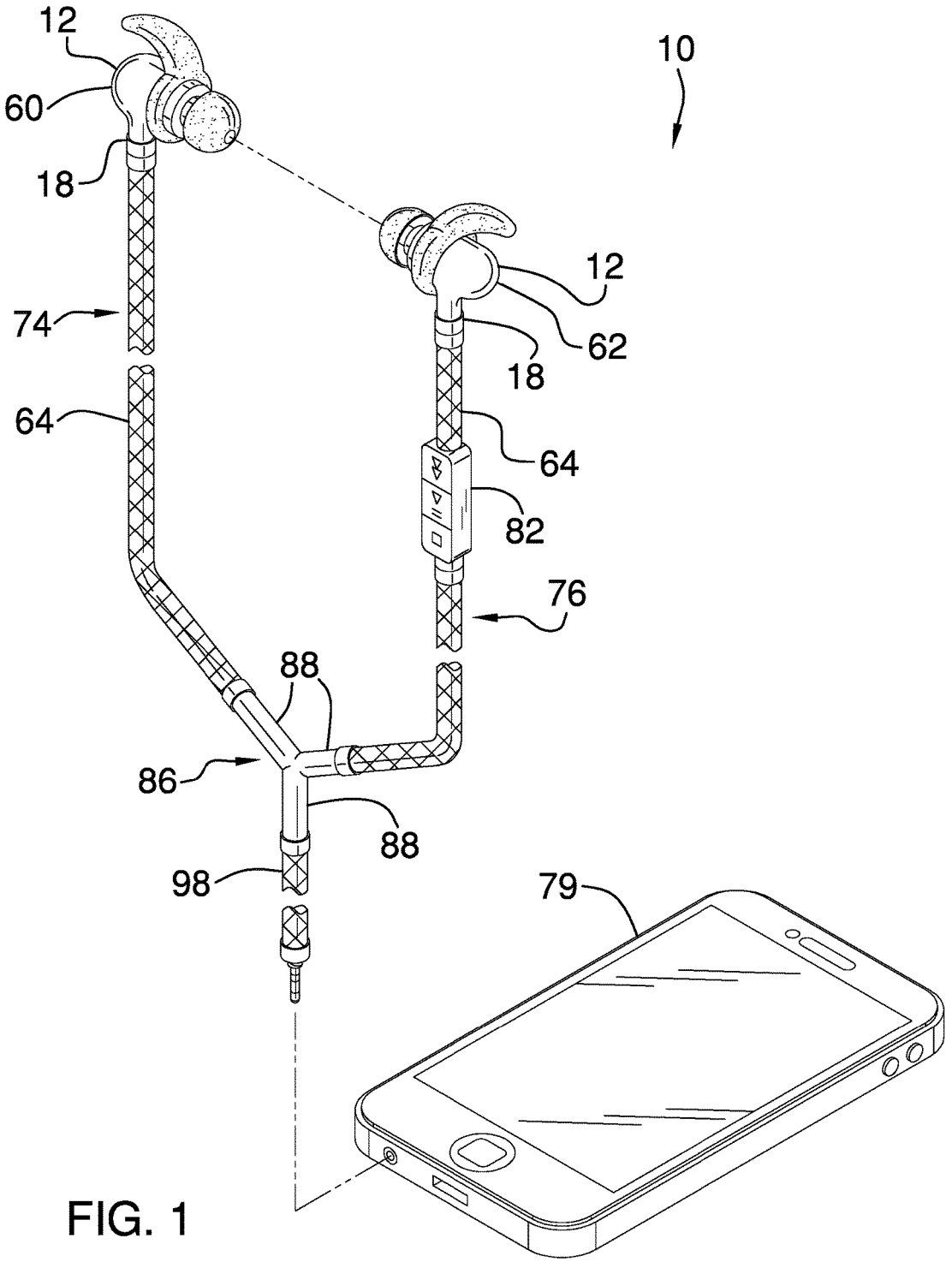
FIG. 1 is a perspective in-use view of a modular ear phone assembly according to an embodiment of the disclosure.
Figure 2:
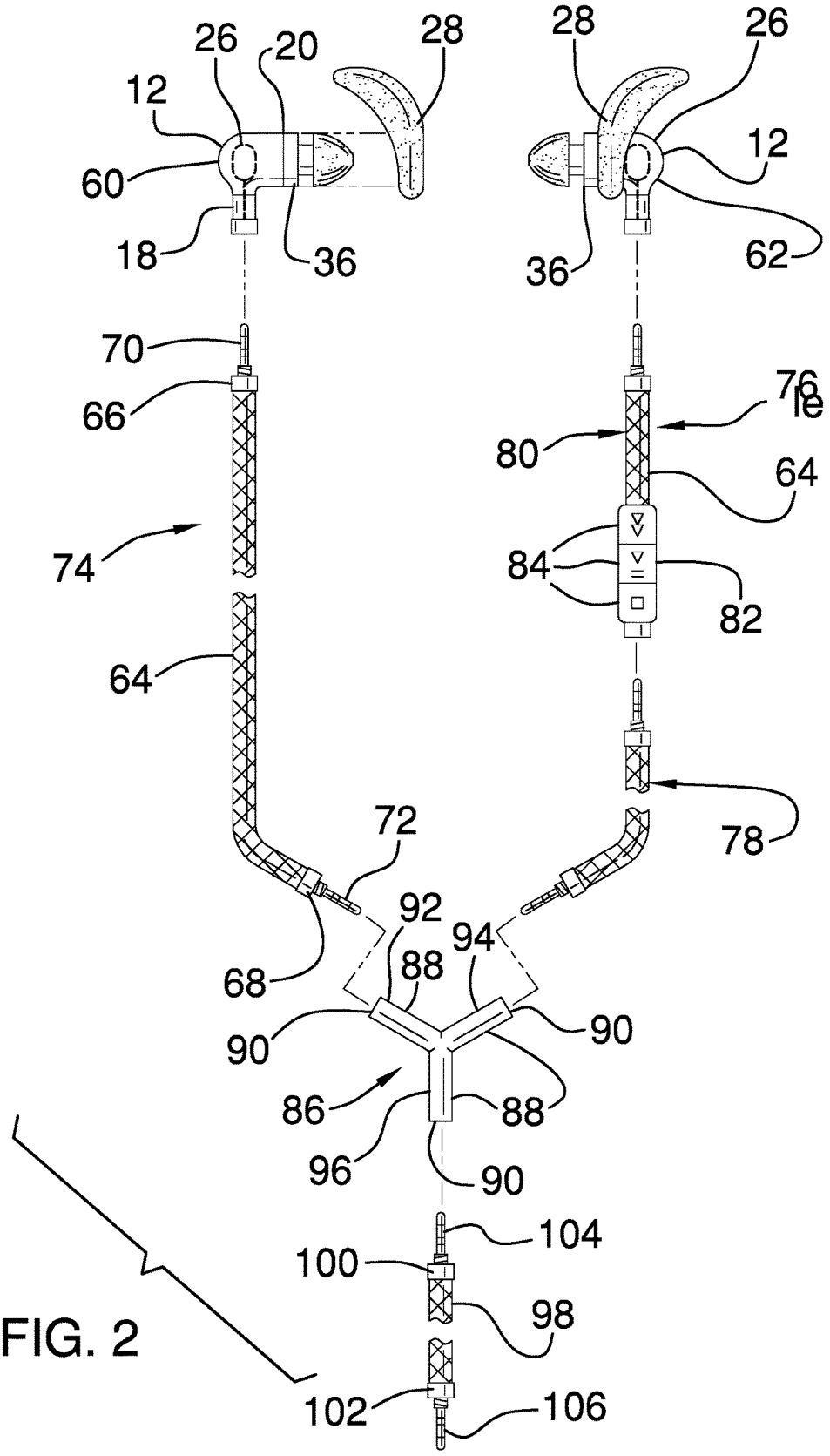
FIG. 2 is an exploded front perspective view of an embodiment of the disclosure.
Figure 3:
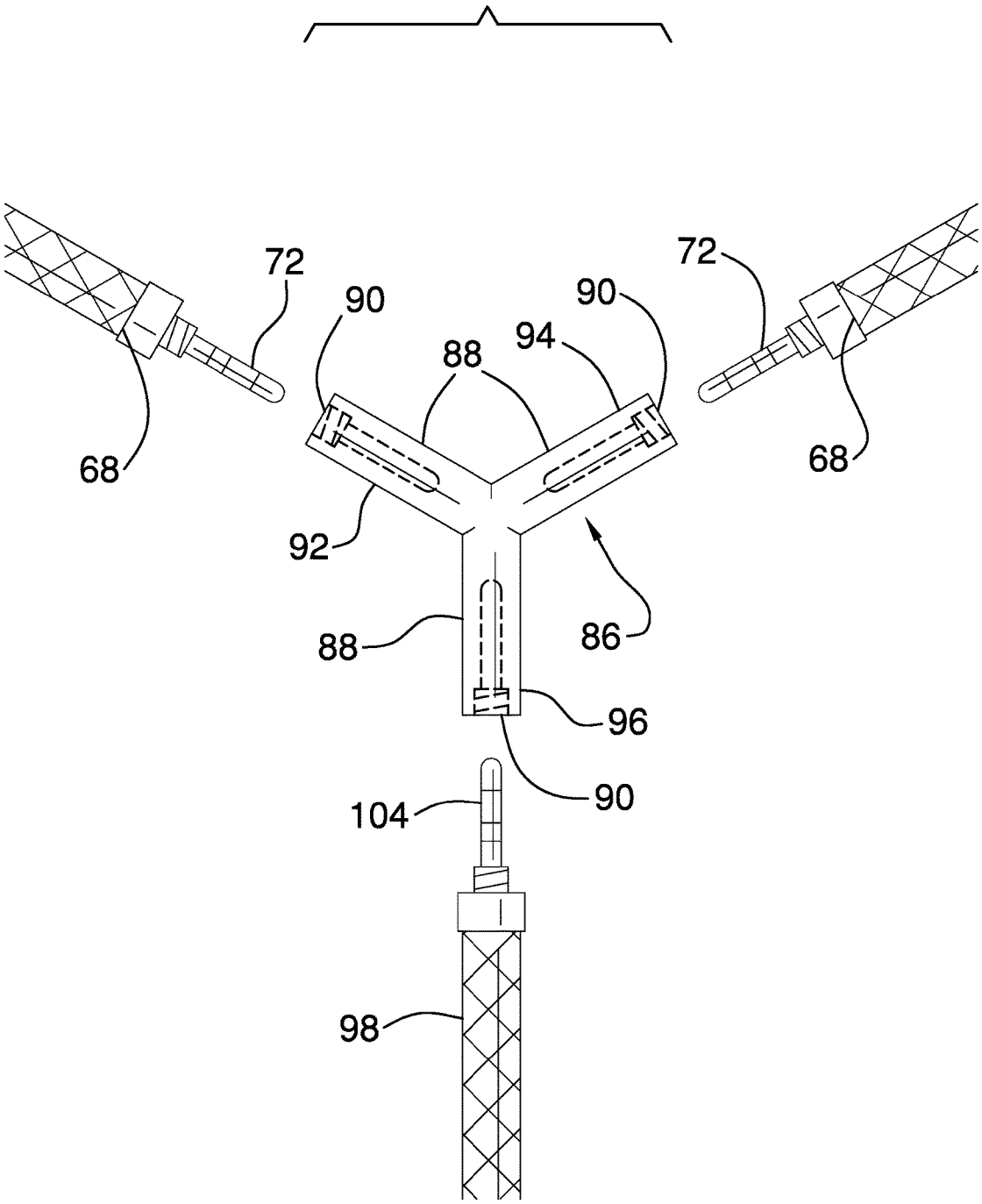
FIG. 3 is an exploded front view of an embodiment of the disclosure.
Figure 4:
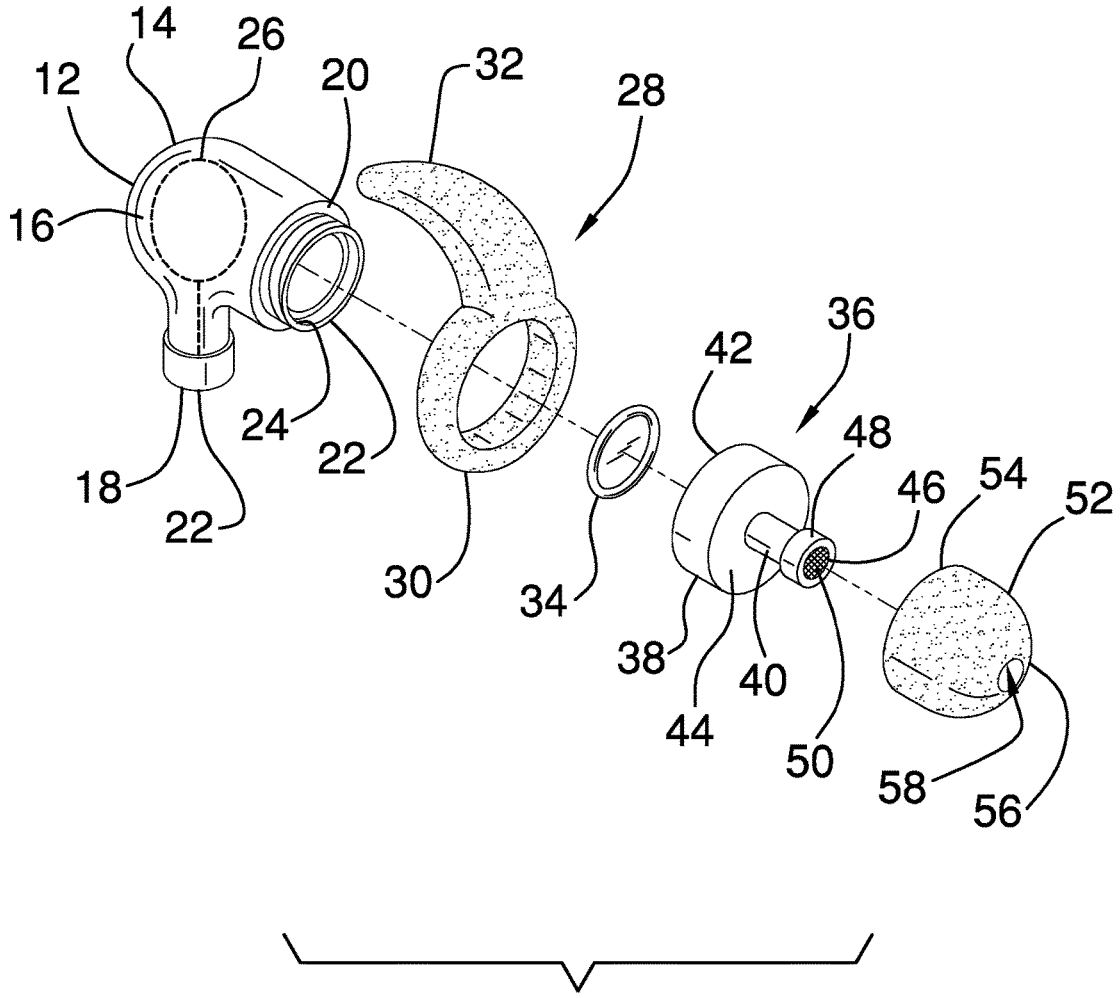
FIG. 4 is an exploded view of an embodiment of the disclosure.
Figure 5:
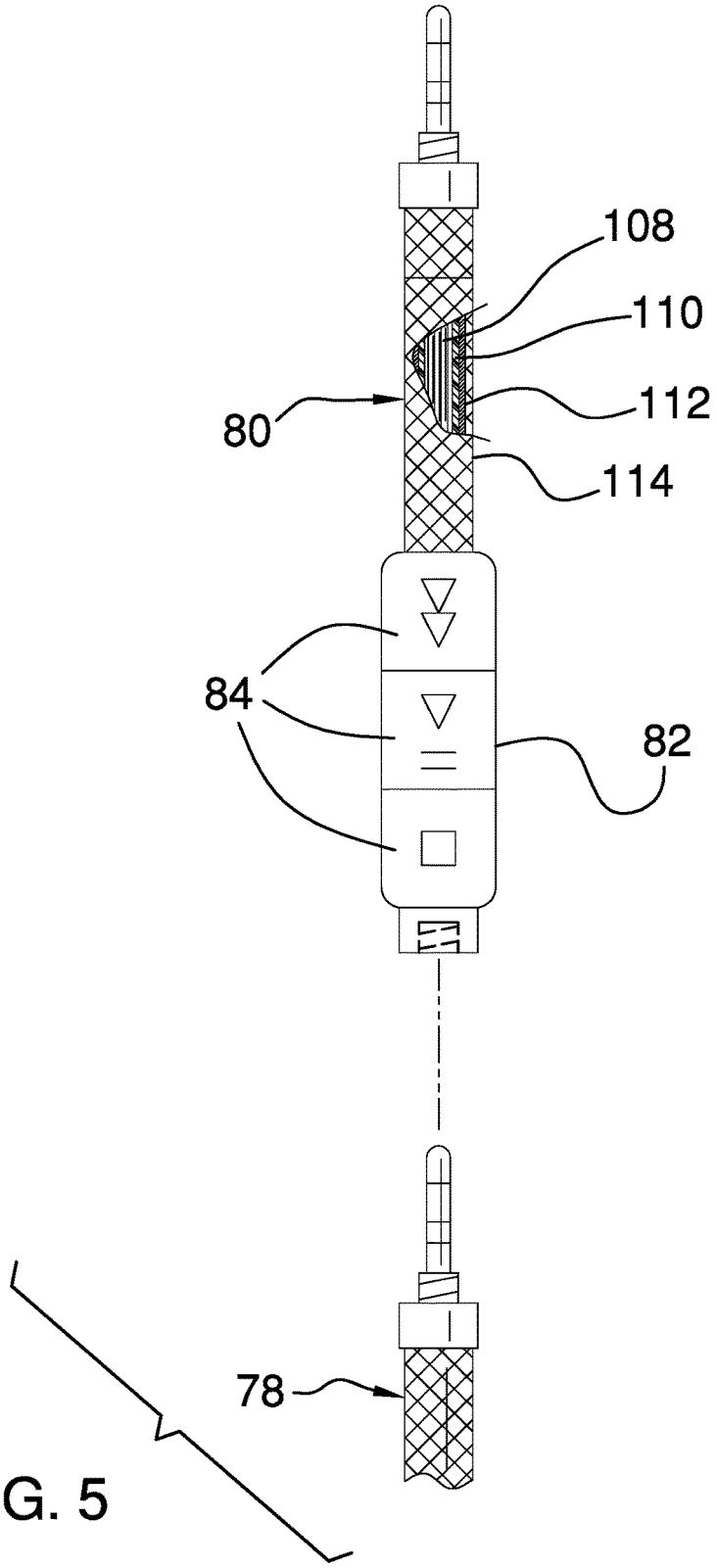
FIG. 5 is a cut-away view of an embodiment of the disclosure.

With reference now to the drawings, and in particular to FIGS. 1 through 5 thereof, a new ear phone device embodying the principles and concepts of an embodiment of the disclosure and generally designated by the reference numeral 10 will be described.

As best illustrated in FIGS. 1 through 5, the modular ear phone assembly 10 generally comprises a pair of ear buds 12. Each of the ear buds 12 may be positioned in ears. Thus, each of the ear buds 12 may emit audible sound into the ears. Each of ear buds 12 may comprise smart phone ear buds 12 or the like.

Each of the ear buds 12 comprises a housing 14 that has an outer wall 16. The outer wall 16 is continuous such that the housing 14 is substantially spherical. The housing 14 has an input 18 extending away from the outer wall 16. Additionally, the housing 14 has an output 20 extending away from the outer wall 16. The input 18 is oriented to be perpendicular to the output 20.

Each of the input 18 and the output 20 has a distal end 22 with respect to the housing 14. The input 18 corresponding to each of the input 18 and the output 20 is open. The distal end 22 corresponding to the output 20 has a bounding edge 24. The bounding edge 24 is continuous such that the distal end 22 corresponding to the output 20 has a circular shape.

A speaker 26 is provided and the speaker 26 is positioned within the housing 14. The speaker 26 is electrically coupled to the input 18. The speaker 26 may emit audible sound outwardly from the output 20. The speaker 26 may comprise an electronic speaker 26 or the like.

A grip 28 is provided and the grip 28 is removably coupled around the output 20. The grip 28 comprises a ring 30 and a fin 32 extending away from the ring 30. The ring 30 is positioned around the output 20 having the fin 32 extending toward the housing 14. Thus, the fin 32 may be manipulated thereby facilitating the ear buds 12 to be inserted and removed from the ear. A gasket 34 is provided. The gasket 34 is continuous such that the gasket 34 forms a closed loop and the gasket 34 is positioned around the output 20.

A cap 36 is provided. The cap 36 has a cup 38 and a stem 40 extending away from the cup 38. The cup 38 has a first side 42 and a second side 44. The first side 42 is open and the stem 40 is positioned on the second side 44. The stem 40 has a distal end 46 with respect to the second side 44 and the distal end 46 of the stem 40 is open.

The first side 42 insertably receives the output 20. Thus, the stem 40 may extend into the ear thereby facilitating the stem 40 to direct the audible sound into the ear. The stem 40 has a flange 48 extending outwardly therefrom. The flange 48 extends around the distal end of the stem 40. The cup 38 frictionally engages the gasket 34 such that the cap 36 is removably retained on the output 20. A screen 50 is positioned in the distal end 46 of the stem 40 to inhibit debris from entering the stem 40.

A bowl 52 is provided that has a first side 54 and an open side 56. The first side 54 of the bowl 52 has an opening 58 extending therethrough. The open side insertably receives the stem 40 having the opening 58 being aligned with the distal end 46 of the stem 40. Thus, the opening 58 emits the audible sound.

The bowl 52 frictionally engages the flange 48 such that the bowl 52 is removably retained on the stem 40. The bowl 52 is comprised of a resiliently compressible material and the bowl 52 frictionally engages the ear. Thus, the associated ear bud 12 is removably retained in the ear. The pair of ear buds 12 includes a first ear bud 60 and a second ear bud 62.

A pair of cords 64 is provided. Each of the cords 64 is selectively electrically coupled to an associated one of the ear buds 12. Each of the cords 64 comprises an insulated electrical conductor 98 or the like. Each of the cords 64 has a first end 66 and a second end 68.

Each of the cords 64 comprises a first plug 70 that is electrically coupled to the first end 66. The first plug 70 is selectively inserted into the input 18 of the associated ear bud. Thus, the first plug 70 is in electrical communication with the speaker 26 corresponding to the associated ear bud. A second plug 72 is electrically coupled to the second end 68.

The pair of cords 64 includes a first cord 74 and a second cord 76. The first cord 74 is electrically coupled to the first ear bud 60. The second cord 76 is electrically coupled to the second ear bud 62. The second cord 76 is split into a first half 78 and a second half 80.

The first half 78 is electrically matable to the second half 80. A control 82 is provided. The control 82 is electrically to the second half 80 and the control 82 may be manipulated. The control 82 includes a plurality of buttons 84 and each of the buttons 84 may be manipulated. Each of the buttons 84 controls operational parameters of the ear buds 12. The plurality of buttons 84 may include a fast forward button, a play/pause button and a stop button.

A coupler 86 is provided and each of the cords 64 is selectively electrically coupled thereto. The coupler 86 comprises a plurality of sleeves 88 and each of sleeves 88 is coupled together. Each of the sleeves 88 radiates outwardly from a center of the coupler 86. Thus, the coupler 86 has a Y-shape.

Each of the sleeves 88 has a free end 90. The plurality of sleeves 88 includes a first sleeve 92, a second sleeve 94 and a third sleeve 96. Each of the first sleeve 92 and the second sleeve 94 is in electrical communication with the third sleeve. The second plug 72 corresponding to the first cord 74 is selectively electrically coupled to the free end 90 of the first sleeve 92. The second plug 72 corresponding to the second cord 76 is selectively electrically coupled to the free end 90 of the second sleeve 94. The free end 90 of each sleeve may comprise a female ¼ audio jack or the like.

A conductor 98 is provided and the conductor 98 is selectively electrically coupled to the coupler 86. The conductor 98 may be selectively electrically coupled to an audio source 79. Thus, the ear buds 12 emit audible sound received from the audio source 79. The audio source 79 may comprise a smart phone or other hand held audio source 79. The conductor 98 may comprise an insulated electrical conductor 98 or the like.

The conductor 98 has a primary end 100 and a secondary end 102. A primary plug 104 is electrically coupled to the primary end 100. The primary plug 104 is selectively electrically coupled to the third sleeve 96 on the coupler 86. Thus, the conductor 98 is in electrical communication with each of the first cord 74 and the second cord 76.

A secondary plug 106 is electrically coupled to the secondary end 102. The secondary plug 106 may be electrically coupled to the audio source 79. Thus, an audio signal is delivered to the ear buds 12. Each of the first plug 70, the second plug 72, the primary plug 104 and the secondary plug 106 may comprise a male ¼ inch audio plug or the like.

Each of the pair of cords 64 and the conductor 98 has a central core 108. The central core 108 comprises an electrical conductor. Each of the pair of cords 64 and the conductor 98 has a first insulation layer 110. The first insulation layer 110 may be comprised of an electrically insulating material such as rubber or the like.

Each of the pair of cords 64 and the conductor 98 has a second insulation layer 112. The second insulation layer 112 may be comprised of a braided metallic material or the like. Thus, a service life of each of the cords 64 and the conductor 98 is enhanced. Each of the pair of cords 64 and the conductor 98 has an exterior layer 114. The exterior layer 114 may be comprised of a translucent and electrically insulating material such as opaque rubber or the like.

In use, each component of the ear buds 12 is assembly in the previously described manner. Each of the first cord 74 and the second cord 76 are electrically coupled to the associated ear buds 12. Each of the first cord 74 and the second cord 76 are electrically coupled to the coupler 86. The conductor 98 is electrically coupled between the coupler 86 and the audio source 79. Each ear bud, the first cord 74, the second cord 76, the coupler 86 and the conductor 98 are replaced as needed. Thus, an entire set of headphones does not need to be purchased when a single component ceases functioning.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular ear phone assembly being configured to be selectively broken down into individual components, said assembly comprising:

a pair of ear buds, each of said ear buds being configured to be positioned in ears thereby facilitating each of said ear buds to emit audible sound into the ears, each of said ear buds comprising a housing having an outer wall, said outer wall being continuous such that said housing is substantially spherical, said housing having an input extending away from said outer wall, said housing having an output extending away from said outer wall, said input being oriented to be perpendicular to said output;

a pair of cords, each of said cords being selectively electrically coupled to an associated one of said ear buds, a coupler having each of said cords being selectively electrically coupled thereto;

a conductor being selectively electrically coupled to said coupler, said conductor being configured to be selectively electrically coupled to an audio source thereby facilitating said ear buds to emit audible sound received from the audio source;

a cap having a cup and a stem extending away from said cup, said cup having a first side and a second side, said first side being open, said stem being positioned on said second side, said stem having a distal end with respect to said second side, said distal end of said stem being open, said first side insertably receiving said output wherein said stem is configured to extend into the ear thereby facilitating said stem to direct the audible sound into the ear; and a screen being positioned in said distal end of said stem wherein said screen is configured to inhibit debris from entering said stem.

2. The assembly according to claim 1, wherein each of said input and said output has a distal end with respect to said housing, said input corresponding to each of said input and said output being open, said distal end corresponding to said output having a bounding edge, said bounding edge being continuous such that said distal end corresponding to said output has a circular shape.

3. The assembly according to claim 1, further comprising a speaker being positioned within said housing, said speaker being electrically coupled to said input, said speaker being configured to emit audible sound outwardly from said output.

4. The assembly according to claim 1, further comprising a gasket being continuous such that said gasket forms a closed loop, said gasket being positioned around said output.

5. The assembly according to claim 1, further comprising a grip being removably coupled around said output, said grip comprising a ring and a fin extending away from said ring, said ring being positioned around said output having said fin extending toward said housing wherein said fin is configured to be manipulated thereby facilitating said ear bud to be inserted and removed from the ear.

6. The assembly according to claim 1, wherein said stem has a flange extending outwardly therefrom, said flange extending around said distal end of said stem, said cup frictionally engaging said gasket such that said cap is removably retained on said output.

7. The assembly according to claim 6, further comprising a bowl having a first side and an open side, said first side of said bowl having an opening extending therethrough, said open side insertably receiving said stem having said opening being aligned with said distal end of said stem wherein said opening is configured to emit the audible sound, said bowl frictionally engaging said flange such that said bowl is removably retained on said stem, said bowl being comprised of a resiliently compressible material wherein said bowl is configured to frictionally engage the ear thereby facilitating said ear bud to be removably retained in the ear.

8. The assembly according to claim 3, wherein each of said cords comprises:

a first end and a second end;

a first plug being electrically coupled to said first end, said first plug being selectively inserted into said input of said associated ear bud such that said first plug is in electrical communication with said speaker corresponding to said associated ear bud; and a second plug being electrically coupled to said second end.

9. The assembly according to claim 8, wherein:

said pair of ear buds including a first ear bud and a second ear bud; and said pair of cords includes a first cord and a second cord, said first cord being electrically coupled to said first ear bud, said second cord being electrically coupled to said second ear bud.

10. The assembly according to claim 9, wherein said second cord is split into a first half and a second half, said first half being electrically matable to said second half, said first half having a control being electrically coupled thereto wherein said control is configured to be manipulated, said control having a plurality of buttons thereon, each of said buttons controlling operational parameters of said ear buds.

11. The assembly according to claim 9, wherein:

said coupler comprises a plurality of sleeves, each of sleeves being coupled together, each of said sleeves radiating outwardly from a center of said coupler such that said coupler has a Y-shape, each of said sleeves having a free end; and said plurality of sleeves including a first sleeve, a second sleeve and a third sleeve, each of said first sleeve and said second sleeve being in electrical communication with said third sleeve, said first plug corresponding to said first cord being selectively electrically coupled to said free end of said first sleeve, said second plug corresponding to said second cord being selectively electrically coupled to said free end of said second sleeve.

12. The assembly according to claim 3, wherein said conductor comprises:

a primary end and a secondary end;

a primary plug being electrically coupled to said primary end, said primary plug being selectively electrically coupled to said third sleeve on said coupler such that said conductor is in electrical communication with each of said first cord and said second cord; and a secondary plug being electrically coupled to said secondary end wherein said secondary plug is configured to be electrically coupled to the audio source thereby facilitating an audio signal to be delivered to said ear buds.

13. A modular ear phone assembly being configured to be selectively broken down into individual components, said assembly comprising:

a pair of ear buds, each of said ear buds being configured to be positioned in ears thereby facilitating each of said ear buds to emit audible sound into the ears, each of said ear buds comprising:

a housing having an outer wall, said outer wall being continuous such that said housing is substantially spherical, said housing having an input extending away from said outer wall, said housing having an output extending away from said outer wall, said input being oriented to be perpendicular to said output, each of said input and said output having a distal end with respect to said housing, said input corresponding to each of said input and said output being open, said distal end corresponding to said output having a bounding edge, said bounding edge being continuous such that said distal end corresponding to said output has a circular shape, a speaker being positioned within said housing, said speaker being electrically coupled to said input, said speaker being configured to emit audible sound outwardly from said output, a grip being removably coupled around said output, said grip comprising a ring and a fin extending away from said ring, said ring being positioned around said output having said fin extending toward said housing wherein said fin is configured to be manipulated thereby facilitating said ear bud to be inserted and removed from the ear, a gasket being continuous such that said gasket forms a closed loop, said gasket being positioned around said output, a cap having a cup and a stem extending away from said cup, said cup having a first side and a second side, said first side being open, said stem being positioned on said second side, said stem having a distal end with respect to said second side, said distal end of said stem being open, said first side insertably receiving said output wherein said stem is configured to extend into the ear thereby facilitating said stem to direct the audible sound into the ear, said stem having a flange extending outwardly therefrom, said flange extending around said distal end of said stem, said cup frictionally engaging said gasket such that said cap is removably retained on said output, a screen being positioned in said distal end of said stem wherein said screen is configured to inhibit debris from entering said stem, and a bowl having a first side and an open side, said first side of said bowl having an opening extending therethrough, said open side insertably receiving said stem having said opening being aligned with said distal end of said stem wherein said opening is configured to emit the audible sound, said bowl frictionally engaging said flange such that said bowl is removably retained on said stem, said bowl being comprised of a resiliently compressible material wherein said bowl is configured to frictionally engage the ear thereby facilitating said ear bud to be removably retained in the ear, said pair of ear buds including a first ear bud and a second ear bud;

a pair of cords, each of said cords being selectively electrically coupled to an associated one of said ear buds, each of said cords comprising:

a first end and a second end, a first plug being electrically coupled to said first end, said first plug being selectively inserted into said input of said associated ear bud such that said first plug is in electrical communication with said speaker corresponding to said associated ear bud, and a second plug being electrically coupled to said second end, said pair of cords including a first cord and a second cord, said first cord being electrically coupled to said first ear bud, said second cord being electrically coupled to said second ear bud, said second cord being split into a first half and a second half, said first half being electrically matable to said second half, said first half having a control being electrically coupled thereto wherein said control is configured to be manipulated, said control having a plurality of buttons thereon, each of said buttons controlling operational parameters of said ear buds;

a coupler having each of said cords being selectively electrically coupled thereto, said coupler comprising a plurality of sleeves, each of sleeves being coupled together, each of said sleeves radiating outwardly from a center of said coupler such that said coupler has a Y-shape, each of said sleeves having a free end, said plurality of sleeves including a first sleeve, a second sleeve and a third sleeve, each of said first sleeve and said second sleeve being in electrical communication with said third sleeve, said first plug corresponding to said first cord being selectively electrically coupled to said free end of said first sleeve, said second plug corresponding to said second cord being selectively electrically coupled to said free end of said second sleeve; and a conductor being selectively electrically coupled to said coupler, said conductor being configured to be selectively electrically coupled to an audio source thereby facilitating said ear buds to emit audible sound received from the audio source, said conductor comprising:

a primary end and a secondary end, a primary plug being electrically coupled to said primary end, said primary plug being selectively electrically coupled to said third sleeve on said coupler such that said conductor is in electrical communication with each of said first cord and said second cord, and a secondary plug being electrically coupled to said secondary end wherein said secondary plug is configured to be electrically coupled to the audio source thereby facilitating an audio signal to be delivered to said ear buds.

* * * * *